United States Patent [19]

Baclit

[11] 4,252,237

[45] Feb. 24, 1981

[54] CIGARETTE PACKAGE HOLDER COMBINATION

[76] Inventor: Paul S. Baclit, 2167 College View Dr., Monterey Park, Calif. 91754

[21] Appl. No.: 131,187

[22] Filed: Mar. 17, 1980

[51] Int. Cl.[3] ..... B65D 85/10; A24F 19/12; A24F 15/00

[52] U.S. Cl. ..... 206/86; 131/239; 206/236; 206/246

[58] Field of Search ..... 206/86, 85, 87, 88, 206/89, 90–95, 246, 236; 431/343; 131/139, 134

[56] References Cited

U.S. PATENT DOCUMENTS

| | | | |
|---|---|---|---|
| 1,717,320 | 6/1929 | Victor | 206/95 |
| 2,536,725 | 1/1951 | Cleveland | 206/101 |
| 2,843,134 | 7/1958 | Bass | 206/85 |
| 2,990,055 | 6/1961 | Hughes | 206/246 |
| 3,057,180 | 10/1962 | Steppan | 431/343 |

*Primary Examiner*—William T. Dixson, Jr.
*Attorney, Agent, or Firm*—Paul H. Gallagher

[57] ABSTRACT

A combination holder for a package of cigarettes and ancillary items. It includes a main compartment for the cigarettes, a compartment for ashes and butts, one for a book of matches, and one for a lighter, and a clip for detachably clipping onto a person's belt, or a sun visor in an automobile, etc. An extinguisher is included in the ash compartment in the form of a perforated metal insert. The holder is unitary and effectively integral. It is preferably of plastic material, and it includes a cover for the main compartment and a cover for the ash compartment that are swingable between closed and opened positions, and are integral with the body of the holder.

6 Claims, 6 Drawing Figures

Fig. 1.
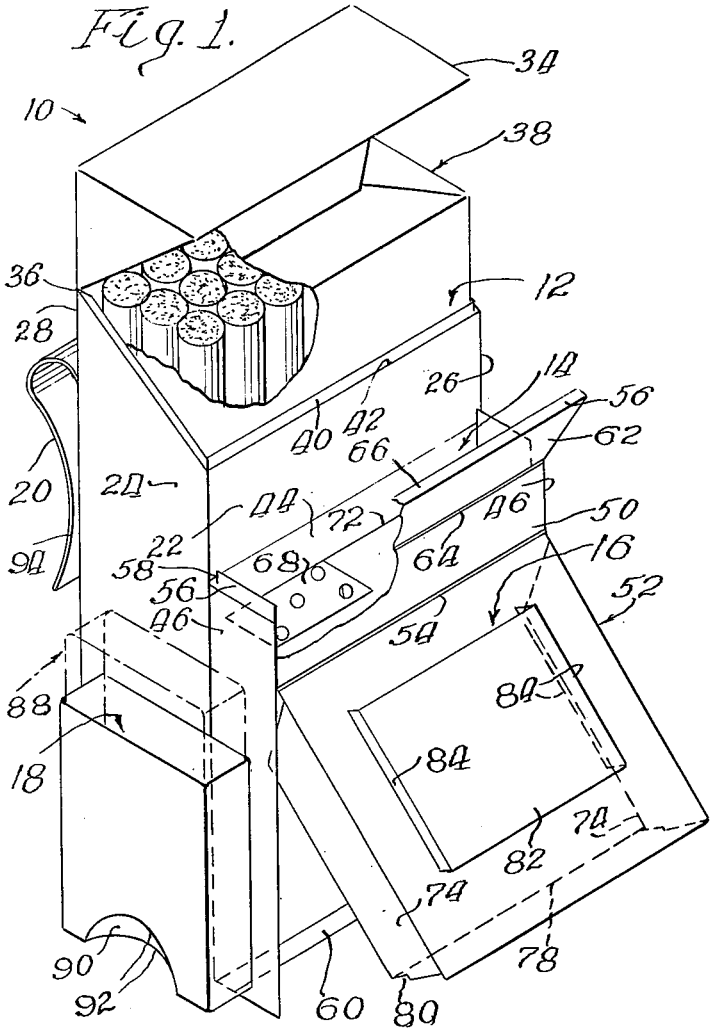
Fig. 2.
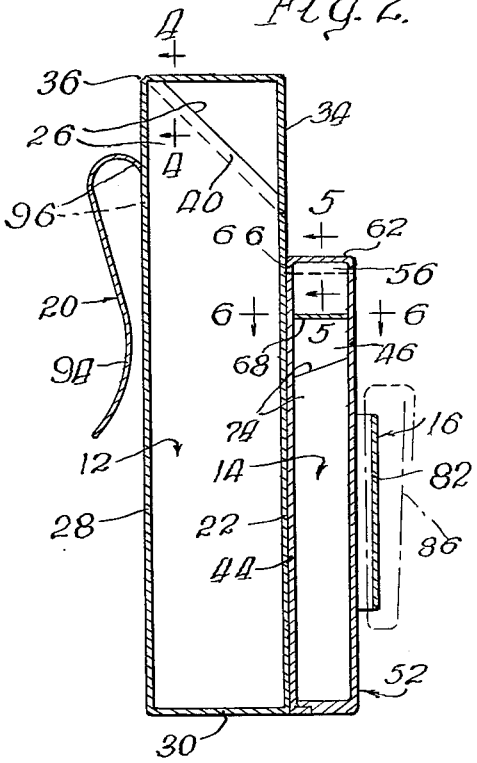
Fig. 3.
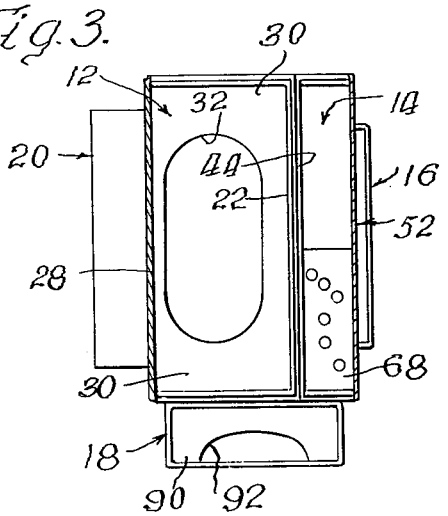
Fig. 4.
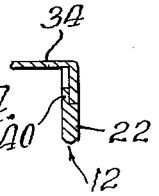
Fig. 5.
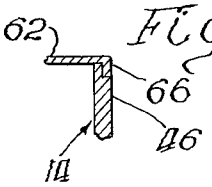
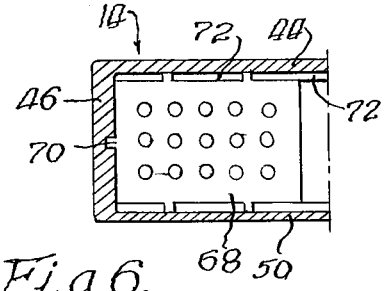
Fig. 6.

CIGARETTE PACKAGE HOLDER COMBINATION

OBJECTS OF THE INVENTION

A broad object of the invention is to provide a combination holder for a cigarette package and ancillary items, having a main compartment for holding a package of cigarettes, and additional compartments for ashes, matches, and lighter, and a clip for mounting it, of novel design, arrangement of components, and construction, which is:

(a) complete and self-contained, (b) very convenient and handy to manipulate and use (c) is very attractive in appearince, and (d) economical to manufacture.

DESCRIPTION OF A PREFERRED EMBODIMENT

In the drawings:

FIG. 1 is a perspective view of the combination holder of the invention, with the closure members in open position;

FIG. 2 is a vertical transverse sectional view of the holder, with the closure members in closed position;

FIG. 3 is a top view with the covers to the cigarette compartment and ash compartment removed;

FIG. 4 is a detail sectional view taken at line 4—4 of FIG. 2;

FIG. 5 is a detail sectional view taken at line 5—5 of FIG. 2; and

FIG. 6 is a detail sectional view taken at line 6—6 of FIG. 2.

Referring in detail to the accompanying drawings, the new holder combination of the invention is shown in its entirety at 10 and includes a main cigarette compartment 12, an ash and butt depository compartment 14, a match compartment 16, and a lighter compartment 18, as well as a clip 20 for releasably mounting the holder or clipping it onto a convenient item, such as one's belt, or a visor in an automobile, or other item.

As used herein, compartment refers to the physical structure defining an interior space, as well as that space itself.

The new combination holder may be made of any of various materials, but plastic material has been found the best, particularly because of the facility with which the holder can be formed therefrom.

The main compartment 12 includes a body a front wall 22, side walls 24, 26 and a rear wall 28. It includes a bottom wall 30 having an aperture 32 (FIG. 3) for insertion of the finger to facilitate removal of the cigarette package. The compartment 12 has an open top closed by a cover or lid 34 secured to the remaining portion of the structure by a hinge element 36.

As noted above, it is desired that the item be made of plastic material, or principally so, and in forming the main compartment 12, the cover is made integral with the remainder of the compartment, that is, integral with the back wall 28 thereof, and the hinge element 36 is known as a "live hinge". The compartment thus described can be formed by presently known means and details of the fabrication thereof need not be entered into.

FIG. 1 shows a package of cigarettes 38 in the main compartment 12 and for more fully exposing the cigarettes when the cover is open, the top of the compartment is disposed at an angle and the cover is appropriately shaped so that when it is closed it forms a square shape with the body of the compartment. Preferably the upper open end of the compartment has an inner upstanding flange 40 outwardly of which is a shoulder 42, and when the cover is closed, it fits over the flange as shown in FIG. 4, the elements being so dimensioned that the cover is normally held in closed position by frictional engagement with the flange, in the absence of applied pressure for opening it.

FIG. 1 shows the various elements in single line representation, without showing thickness by double lines, for ease in depicting the overall shape and proportions.

The ash compartment 14 includes a body, a back wall 44 extending substantially the full dimension of the compartment, side walls 46, and a front wall element 50 of short vertical dimension, at the top of the compartment, to which is secured an integral door 52 by means of a "live hinge" 54. The side walls have top extensions 56 spaced forwardly from the front wall 22 of the main compartment at 58, and the rear wall 44 has a forwardly extending short horizontal wall or ledge 60 at its lower end. The ash compartment is provided with an integral cover 62 secured to the front wall 50 by means of a "live hinge" 64 having a downwardly extending flange 66 around the other three sides. The cover is movable down into closed position (FIG. 2) in which the flange 66 fits around the extensions 56 and into the space 58, and is normally held in such closed position by friction.

The ash compartment is provided with a cigarette extinguisher 68 which is preferably in the form of a metal insert having tabs 70 which extend into the surrounding wall elements, the latter being provided with grooves 72 receiving the tabs. The insert may be put in position easily by sliding it in the grooves, or bowing it and snapping it into position.

The door 52 is provided with side walls 74, and a bottom wall 78, extending inwardly from its inner surface, and when the door is in closed position (FIG. 2) the three walls mentioned, together with the side walls 46 and bottom ledge 60, form the lower and main portion of the ash compartment. Preferably the lower wall 78 is provided with a notch or cut out 80 receiving the ledge 60, and the lower edge of the door has friction engagement with the ledge, and the door is normally held in closed position thereby.

The ash compartment 14 and main compartment 12 may be separate pieces, but in the formation and fabrication of the device, the two walls 44, 22 are secured together in a known manner, and become unitary and effectively integral.

The match compartment includes a flat plate 82 having side flanges 84 extending rearwardly and secured to the front surface of the door 52, spacing the panel 82 outwardly therefrom. A common and well-known kind of match book 86 is held in the match compartment as shown in FIG. 2. The term compartment is applied to the item 16 in its broadest sense.

In the use of the holder, the user may place ashes in the ash compartment 14, if he happens to be in a place where no ashtray is found. The metal extinguisher 68 is convenient for extinguishing cigarettes and the butts can then be dropped in the ash compartment, and then the cover 62 closed to confine the ashes and butts, so that it can conveniently be carried in the pocket or the purse. The ash compartment is easily emptied by merely grasping the lower edge of the door 52 and opening it, and the ashes and butts are thereby easily emptied, there being large and open spaces facilitating that action.

The lighter compartment 18 is a simple open-top pocket fitted over and secured to both the side wall 24 of the main compartment and the side wall 46 of the ash compartment, by suitable means, as referred to above in securing the ash compartment to the main compartment. A lighter is indicated at 88 fitted in the compartment, the latter being dimensioned for snugly receiving the lighter, and normally holding it in place by friction. The compartment is provided with a bottom wall 90, and the bottom wall and side wall together are provided with an aperture 92 for insertion of the finger for facilitating removal of the lighter.

The clip 20 has a spring extension 94 and is mounted in the holder in a convenient manner, such as imbedding the opposite end 96 in the rear wall 28 of the main compartment. The clip 20 may be of any suitable material, of plastic as are the other items, or metal, according to convenience. The combination holder can thus be clipped onto a belt for example or a sun visor in the car, etc., and of course it can be easily carried in the pocket.

The overall device is of attractive appearance, being nearly entirely enclosed, except for the lighter compartment 18. It can be made of many different designs and appearances, plastic material readily lending itself to this result.

A particularly important feature is the novel arrangement of the ash compartment. The cover 62 is normally held in closed position, but it is easily opened for exposing the interior of the ash compartment and the ashes can be easily and unobtrusively placed therein. The unusual design for facilitating emptying of the ashes is of great importance, namely the door 52 is large, providing a large-area opening to the compartment for easily emptying the ashes and butts, and it is easily opened and it is effective held closed in normal use of the device. Because of facility in forming and fabricating the holder from plastic material, the device is extremely economical to manufacture, and can be sold at reasonable retail price.

I claim:

1. A combination holder for a cigarette package and ancillary items comprising, a main component made of thin-wall material that is continuous therearound in transverse directions and having a back wall and a large-expense front wall, the main compartment including a body having a cover integral with the back wall and connected thereto by a live hinge, and swingable about the hinge between an open position and a closed position closing the top of the main compartment, an ash compartment made of thin-wall material and having a back wall substantially commersurate in width with the front wall of the main compartment and secured thereto, the ash compartment having a front side and including a door on the front side extending the width of the ash compartment and integral with the body of the ash compartment and connected thereto by a transverse live hinge at the top of the door adjacent the top of the ash compartment, and swingable about that hinge so that its bottom end swings between a closed position and an open position operable for exposing the interior downwardly for emptying the ash compartment, said door being releasably held by friction in the closed position.

2. A combination holder according to claim 1 wherein, the ash compartment includes means for providing friction for holding the door thereof in closed position, that includes side wall elements on the door and the body of the ash compartment that overlap in frictional interengagement, and body includes a transverse ledge at the bottom and the door has a conformation overlapping with the ledge in frictional interengagement therewith.

3. A combination holder according to claim 1 wherein, the main compartment has an upwardly directed opening having and upwardly extending flange on the sides other than the back wall, and the cover when in closed position overlaps said flange in frictional engagement therewith, the ash compartment has a cover integral with the body of that compartment and connected thereto by a live hinge, and the ash compartment has upwardly extending flanges at the sides spaced forwardly from the front wall of the main compartment, and the cover of the ash compartment is movable between open position and closed position and when in closed position overlapping said flanges in frictional engagement therewith and it frictionally engages the front wall of the main compartment.

4. A combination holder according to claim 3 wherein, the door of the ash compartment is hinged at a position below the top of the compartment, leaving a top space in the compartment above the hinge, and an extinguisher is positioned in said top space, the extinguisher including a perforated metal plate at one side, transversely, leaving the remainder of the top space in communication with the space therebelow.

5. A combination holder according to claim 1 wherein, the holder is provided with a clip on the back thereof for detachably mounting the holder on another object, the clip having one end embedded in the back wall of the main compartment and an outer end exposed therefrom and constituting a spring element for frictionally gripping said object on which the holder is mounted, the holder also includes a compartment on said door of the ash compartment for holding a match folder, said match folder compartment including a flat plate and said flanges secured to the door positioning the flat plate outwardly from the door, and the space between the flat plate and door being open to the exterior at top and bottom for the insertion therethrough of an element of the match folder.

6. A combination holder according to claim 1 wherein, the holder includes a lighter compartment of thin wall material, continuous therearound in transeverse directions and open at the top, and secured to the main compartment and ash compartment at one side of the latter and extending in superposed relation to both of those compartments in front-to-rear direction.

* * * * *